US006371204B1

(12) United States Patent
Singh et al.

(10) Patent No.: US 6,371,204 B1
(45) Date of Patent: Apr. 16, 2002

(54) UNDERGROUND WELL KICK DETECTOR

(75) Inventors: Baldeo Singh, Houston; Richard Dolan, Sugar Land; Benny Mason, Houston, all of TX (US)

(73) Assignee: Union Oil Company of California, El Segundo, CA (US)

( * ) Notice: Subject to any disclaimer, the term of this patent is extended or adjusted under 35 U.S.C. 154(b) by 0 days.

(21) Appl. No.: 09/478,077

(22) Filed: Jan. 5, 2000

(51) Int. Cl.[7] ..... E21B 47/04

(52) U.S. Cl. ..... 166/250.03; 166/255.1; 175/48; 73/152.19

(58) Field of Search ..... 166/250.03, 255.1; 175/48, 25, 218; 73/152.19, 152.24, 152.31, 152.39, 152.46

(56) References Cited

U.S. PATENT DOCUMENTS

| | | | | |
|---|---|---|---|---|
| 3,833,076 A | * | 9/1974 | Griffin, III | 175/38 |
| 4,228,530 A | | 10/1980 | Bergey | 367/112 |
| 4,299,123 A | | 11/1981 | Dowdy | 73/155 |
| 4,446,730 A | | 5/1984 | Smith | 73/301 |
| 4,476,715 A | * | 10/1984 | Murphy | 73/151 |
| 4,522,068 A | | 6/1985 | Smith | 73/32 A |
| 4,527,425 A | | 7/1985 | Stockton | 73/155 |
| 4,546,640 A | | 10/1985 | Stone et al. | 73/19 |
| 4,553,429 A | | 11/1985 | Evans et al. | 73/155 |
| 4,561,307 A | | 12/1985 | Smith | 73/438 |
| 4,733,233 A | | 3/1988 | Grosso et al. | 340/861 |
| 5,063,776 A | * | 11/1991 | Zanker et al. | 73/155 |
| 5,154,078 A | | 10/1992 | Codazzi | 73/155 |
| 5,163,029 A | | 11/1992 | Bryant et al. | 367/83 |
| 5,205,166 A | | 4/1993 | McCann et al. | 73/155 |
| 5,829,530 A | * | 11/1998 | Nolen | 166/369 |
| 5,975,219 A | | 11/1999 | Sprehe | 175/48 |
| 6,230,557 B1 | * | 5/2001 | Ciglenec et al. | 73/152.01 |
| 6,257,354 B1 | * | 7/2001 | Schrader et al. | 175/38 |

FOREIGN PATENT DOCUMENTS

| | | |
|---|---|---|
| EP | 0621397 A1 | 10/1994 |
| EP | 0807831 A2 | 11/1997 |

OTHER PUBLICATIONS

Bang, J. et al., "Acoustic Gas Kick Detection With Wellhead Sonar." SPE 28317, Sep. 25, 1994, XP–002160497, Figures 1–3.

Schubert, J. et al., "Early Kick Detection Through Liquid Level Monitoring in the Wellbore," SPE 39400, Mar. 3, 1998, XP–002160498, p. 889, col. 2, paragraph 3—p. 890, col. 2, paragraph 1, p. 893, col. 1, paragraph 2.

Ravensgate Corporation, "Ravensgate Sonic Water Level Meter," Ridgecrest, CA. (undated).

* cited by examiner

*Primary Examiner*—David Bagnell
*Assistant Examiner*—Zakiya Walker
(74) *Attorney, Agent, or Firm*—William O. Jacobson; Gregory F. Wirzbicki

(57) ABSTRACT

An apparatus for improved detection of underground well kicks, preferably comprising a first acoustic sensor mounted on the top drive of a drilling rig in acoustic contact with a liquid level within a drill string which is generally located within a wellbore, a second acoustic sensor in a trip tank connected to the wellbore, and a drawworks position indicator. The acoustic sensors detect signals reflected from liquid level interfaces allowing calculation of injected liquid volumes from the trip tank into the wellbore and liquid volume changes within the drill string. The drawworks sensor allows calculation of tubular volumes removed from the wellbore over time. Comparison or totaling of calculated volumes allows early detection of unwanted fluid fluxes between the wellbore and an underground formation.

31 Claims, 2 Drawing Sheets

UNDERGROUND WELL KICK DETECTOR

FIELD OF THE INVENTION

This invention relates to underground well devices and processes. More specifically, the invention is concerned with providing a device and method that reduces the risk of uncontrolled formation fluid influx into a well during operations requiring removal of tubular strings from the well.

BACKGROUND OF THE INVENTION

During the drilling, completion, operation, and maintenance of an underground wellbore, e.g., drilling a well to produce oil or gas from an underground formation or reservoir, frequent round trips of tubulars in and out of the wellbore or "tripping" is required. One round trip, for example, might involve removing sections of a drill string from a wellbore otherwise filled with a drilling mud, replacing a worn-out drill bit at the end of the drill string, and returning the string (with a new bit) to the wellbore to continue drilling. As the drill string and/or attached equipment is being removed or pulled out of the wellbore, a replacement fluid is typically supplied from a trip tank to replace the volume of removed drill string and/or attached equipment so that a steady-state hydrostatic pressure is maintained downhole. The replacement fluid is typically also a drilling mud or similar fluid.

However, the string removal operation itself can induce an unwanted fluid exchange between the wellbore and an underground formation. For example, a formation fluid may be induced into the wellbore from an upward swabbing effect of drill string removal that produces frictional forces to help support the column of drilling mud near the top of the wellbore and reduces hydrostatic pressure near the bottom of the string. If the induced formation fluid displaces the drilling mud in the wellbore and has a density lower than the displaced drilling mud, e.g., if the formation fluid is a gas, the hydrostatic pressure near the bottom of the drill string is reduced still further. The reduced hydrostatic pressure can induce the entry of more formation fluids, causing a surface pressure "kick" or other problems.

Similarly, insertion of tubulars can increase bottomhole hydrostatic pressures. Increased bottomhole pressures can force unwanted flows of drilling mud into an underground formation.

In order to detect a kick or other problems during tripping, the volume of liquid supplied from the trip tank over a time period may be measured and compared to a calculated volume of liquid needed to replace the volume of steel drill pipe and other steel equipment removed during the time period. If the calculated steel volume removed is greater than the volume of liquid supplied from the trip tank, then an influx of formation fluid can be assumed to have entered the wellbore and appropriate corrective steps may be taken. If the calculated steel volume is less than the supplied fluid volume observed from the trip tank, drilling or other fluid in the wellbore can be assumed to have entered the underground formation (potentially damaging the formation) and appropriate corrective steps may be taken.

Unfortunately, it is not unusual for the calculated steel volume to be somewhat more or less than the injected fluid volume from the trip tank in the absence of the fluid transfer between the wellbore and a formation. This can be caused by a differential "swabbing" effect of the drill pipe or other equipment being moved within the wellbore resulting in an exchange of fluid within the wellbore, i.e., fluid exchange between the interior and annular exterior of the drill string rather than fluid exchange between the wellbore and an underground formation. Because of the differential swabbing effect and/or other possible reasons, some differences between injected volume (from the trip tank) and removed tubular volumes are typically ignored rather than taken as an early sign of unacceptable fluid exchange with a formation since unnecessarily stopping a round trip can be costly.

But perhaps even more costly or dangerous is not being able to detect the early signs of a kick or other fluid exchange problems. For example, controlling an early-detected small kick may be relatively easy but lengthy delays in detection can result in short tripping, kick control measures such as extensively circulating out the (presumed) kick gas, killing the well, actuation of blowout preventers, or even a well blowout. Similarly, early detection of unwanted drilling fluid or circulation loss into the formation again may be easily controlled or only result in "skin damage" to the formation, but delays in detection and excessive drilling fluid loss can result in lost circulation or drilling problems, permanent formation damage after drilling, and even loss of the well.

SUMMARY OF THE INVENTION

In accordance with the present invention, improved methods and apparatus are described for detecting a fluid exchange between a wellbore and an underground formation. The process of the invention allows one to quickly calculate (using the principle of conservation of mass) and/or correct unwanted fluid exchange between the wellbore and an underground formation by directly measuring essentially all other volume inputs/outputs and volume changes with a wellbore.

One apparatus embodiment of the invention comprises a first acoustic sensor (typically attached to a drill string) for detecting liquid level/volume changes within a drill string, a second or trip tank liquid-level sensor (typically attached to a trip tank) for detecting liquid level/volume changes in a trip tank, and means for measuring the volume of drill string removed from a well, such as counting the number of drill string sections removed over time multiplied by a volume of steel per string section. Another apparatus embodiment of the invention comprises a first liquid volume change or liquid flow sensor attached to a top drive of a drilling rig, a second or trip tank liquid flow sensor attached to the outlet of the trip tank, and means for measuring the distance traveled by drill string tubulars such as a drawworks position indicator. The first liquid level or volume change sensor detects signals reflected from a liquid-level interface within the drill string over time, allowing calculation of measured liquid flow or volume changes within the drill string The trip tank sensor allows calculation of liquid volume exchanges or flow between the trip tank and the wellbore. The drawworks sensor detects movement of the drill string into or out of the wellbore over time. Calculated liquid and solid volume changes within the wellbore over time are compared or totaled. Discrepancies between inflow and outflow or non-zero volume change totals are used to determine if fluid exchange with an underground formation has occurred and/or to take corrective action.

One process embodiment of the invention comprises: (a) drilling a wellbore using a drilling rig and tubulars extending into said wellbore; (b) transmitting a liquid-level interacting signal into said wellbore over time; (c) detecting a plurality of said fluid level-interacting signals over a period of time and calculating an associated measured liquid volume change; (d) measuring the volume change of tubulars withdrawn or inserted into said wellbore over said period of time;

(e) measuring a fluid volume change or liquid flow into or out of said wellbore from a source other than said underground formation over said period of time; (f) totaling said measured volume changes; and (g) correcting unwanted formation fluid fluxes if the totaling step indicates fluid has been exchanged between the wellbore and an underground formation.

BRIEF DESCRIPTION OF THE DRAWINGS

In these Figures, it is to be understood that like reference numerals refer to like elements or features.

DETAILED DESCRIPTION OF THE INVENTION

Figure 1:
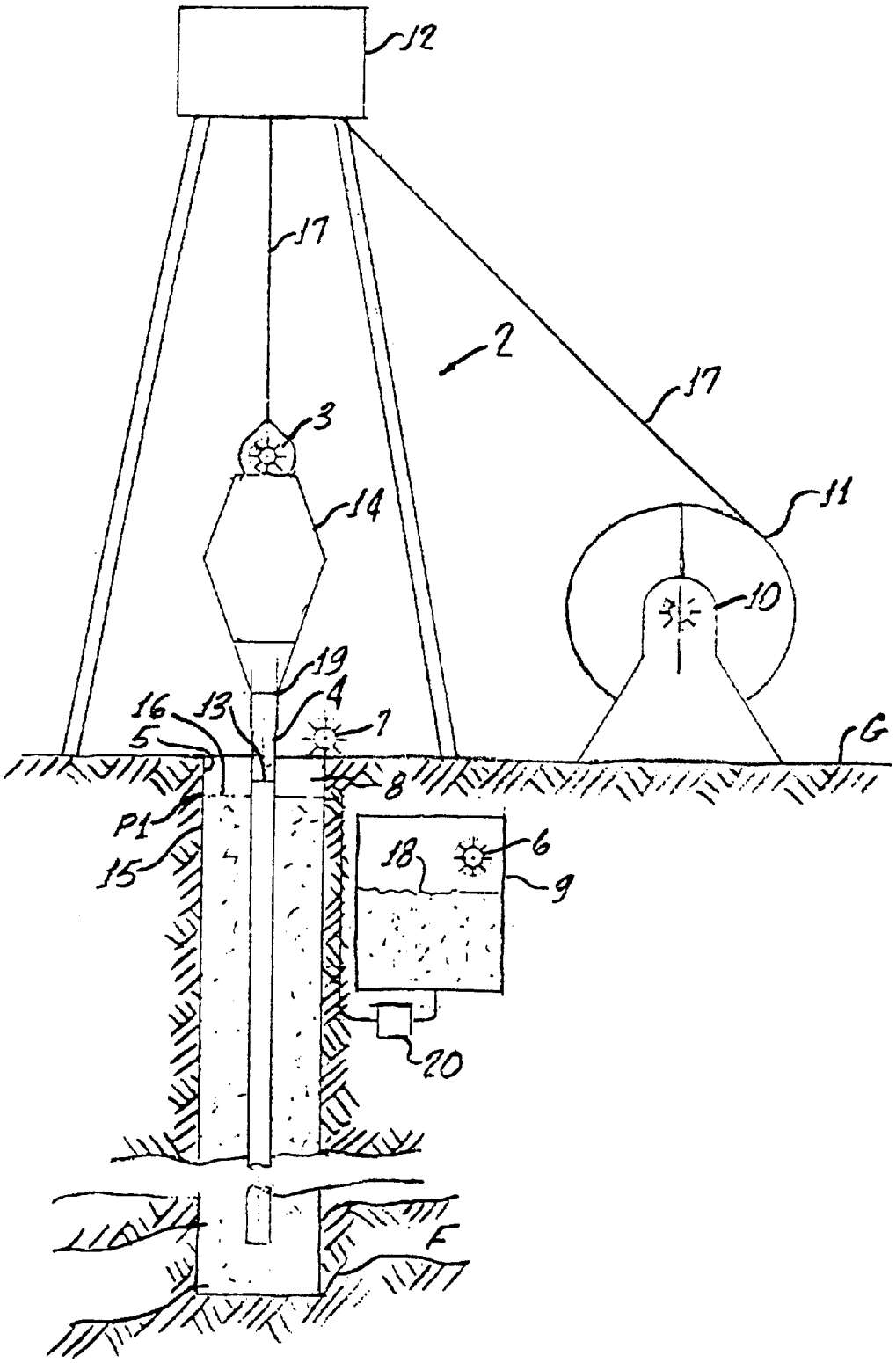
FIG. 1 shows a schematic view of an embodiment of the invention attached to a drill rig at a first position.

FIG. 1 shows a schematic of a kick-detector apparatus embodiment of the invention 2 mounted on a drill rig 12 having a drawworks 11 and a cable 17 supporting a top drive 14 and tubulars 4. The kick-detector apparatus 2 comprises a first acoustic or other liquid-level sensor 3 mounted on the top drive 14 for measuring a liquid-gas interface within a drill string or other tubular 4 within the wellbore 5, a second or trip tank acoustic or other liquid-level interface sensor 6 for measuring a liquid-gas interface within a trip tank 9, an optional third acoustic or other liquid-level sensor 7 for measuring a liquid-gas interface within the annulus 8 between the wellbore 5 and tubular 4, and a displacement sensor or other means for measuring tubular movement and other equipment into or out of the wellbore 5, e.g., a position indicator 10 connected to the drawworks 11.

The first liquid-level sensor 3 is preferably an acoustic-type transmitter and receiver unit. In embodiments where it is desired to measure liquid interface levels possibly above ground level G, the first liquid-level sensor 3 is preferably attached to a bull plug connection on a carriage assembly of a top drive on a drilling or workover rig 12. Placing the first liquid-level sensor 3 at the bull plug connection on the top drive 14 allows the transmitted and reflected acoustic-type signal (not necessarily an audible signal) to have a direct line-of-sight between the first liquid-level sensor and a liquid-gas interface 13 within the drill string 4 supported by the top drive 14.

A preferred transducer is a Datasonics Model E-173H obtainable from Datasonics located in Cataurnet, Ma. Although other acoustic-type transmitters and sensors are possible, low frequency units operating at less than 40 kHz are preferred, most preferably, 2 to 4 kHz.

The location of the first liquid-level sensor 3 is not required to be on the top drive 14 or near the rig floor G. Alternative locations for the first liquid level sensor 3 include attached (a) to a temporary cap placed on top of the drill string or tubular 4 and (b) near the bottom end of the drill string measuring the distance (in liquid) from the bottom end of the drill string to the liquid level gas interface within the string.

Alternative first liquid-level sensors and mounting locations may also be used. Alternative liquid-level sensors include: a laser liquid-level depth sensor mounted near the top of the drill string 4, capacitance or resistivity liquid-level sensors placed within the drill string, a weight sensor located on the top drive 14 or drawworks 11 measuring the weight of the supported drill string (less fluid displacement) and calculating changes in fluid displacement, a natural frequency sensor mounted on the drill string 4 with natural frequency changes correlated to liquid displacement changes within the drill string, a radar liquid level sensor mounted near the top of the drill string, and a thermal imaging sensor viewing the exposed portion of drill string detecting fluid level effects on the exposed drill string.

The second or trip-tank fluid sensor 6 is preferably also an acoustic liquid-level transmitter and receiver for measuring changes in liquid level 18 within the trip tank 9. The second fluid sensor 6 is preferably attached to the trip tank 9 and measures the liquid level 18 in the trip tank at different times so that a calculation over time can be made of the liquid injected into the wellbore 5 from the trip tank and/or received from the wellbore into the trip tank. The trip-tank fluid sensor 6 is preferably attached within the trip tank 9 with a direct line of sight to the liquid-gas interface 18 within the trip tank. However, alternative second fluid sensors and/or locations may also be used, such as an integrating flowmeter located at the outlet of the trip tank 9, a laser depth sensor located within the trip tank, capacitance or resistivity sensors located within the trip tank, a natural frequency (that changes with liquid level changes) vibration sensor located at the trip tank, a radar sensor located within the trip tank, a remote thermal or other imaging of the trip tank capable of determining fluid level within the tank, and a liquid level gauge connected to, but located external to the trip tank.

An optional or third liquid-level sensor 7 is preferably also an acoustic transmitter and receiver unit for detecting changes in fluid interface 16. The optional liquid-level sensor 7 is not required if the liquid interface level 16 in the annulus 8 is controlled. In one liquid-level uncontrolled embodiment, the optional level sensor 7 is preferably attached to a casing string 15 near the ground surface or rig floor G. The preferred placement of the optional sensor 7 allows the transmitted and reflected signal to have a direct line-of-sight between the sensor and a liquid-gas interface 16 within the annular space 8 between the drill string 4 and wellbore 5. However, the location of the optional sensor 7 is not required to be at or near the surface G. Alternate locations for the third liquid level sensor 7 include contacting the casing 15 below the drill floor or ground level G, attached to a temporary cap placed on bottom of drill string 4 measuring the distance (in annulus liquid) from a downhole drill bit to the gas interface surface in the annulus 8.

In addition to acoustic types of fluid sensors, alternative third fluid sensors may also be used that are similar to the alternative first liquid-level sensors. Alternative locations for the alternative third fluid sensors may also be used, e.g., within the casing 15.

The drawworks indicator 10 or other means for measuring the length or amount of tubulars 4 and associated equipment removed or inserted into the wellbore 5 is preferably connected to the drawworks 11. The preferred drawworks indicator 10 measures the rotation of the drum or drawworks 11 that lifts or lowers the top drive 14 supporting the tubulars or drill string 4. The motion of the drum 11 can be related to the length of tubulars 4 removed from or inserted into the wellbore 5 using the radius of the drum to obtain a distance traveled by the cable 17 supporting the top drive 14. The measured length of tubulars 4 inserted into or withdrawn from the wellbore 5 can be used to calculate a volume of tubulars inserted or withdrawn. Alternative means for measuring the length or amount of tubulars 4 (in sections) and associated equipment removed from the wellbore 5 includes manually counting of the number of pipe sections removed or inserted into the wellbore (and converting the number of sections to a volume of the sections removed or inserted), a weight sensor on the top drive 14 (and converting the weight change to a volume of tubulars and associated equipment 5 withdrawn or inserted), and tubular position indicators.

Calculation of the liquid volume changes (e.g., in tubulars 4, in the annulus 8, and in the trip tank 9) and tubular/equipment volume changes within the wellbore 5 may require additional refinements or corrections. This may include: correcting for the stretch of cable 17, tubulars 4, or other equipment under changing load conditions; including calculations for transient as well as steady state fluid conditions; correcting for the compressibility or outgassing of fluids or drilling muds under changing pressure conditions; correcting for the loss of fluid when tubular sections are removed or spillage occurs at the drilling table; correcting the drum radius for cable thicknesses on the drum 11; and correcting for any filling of the wellbore 5 or drill string 4 from sources other than an underground formation.

Figure 2:
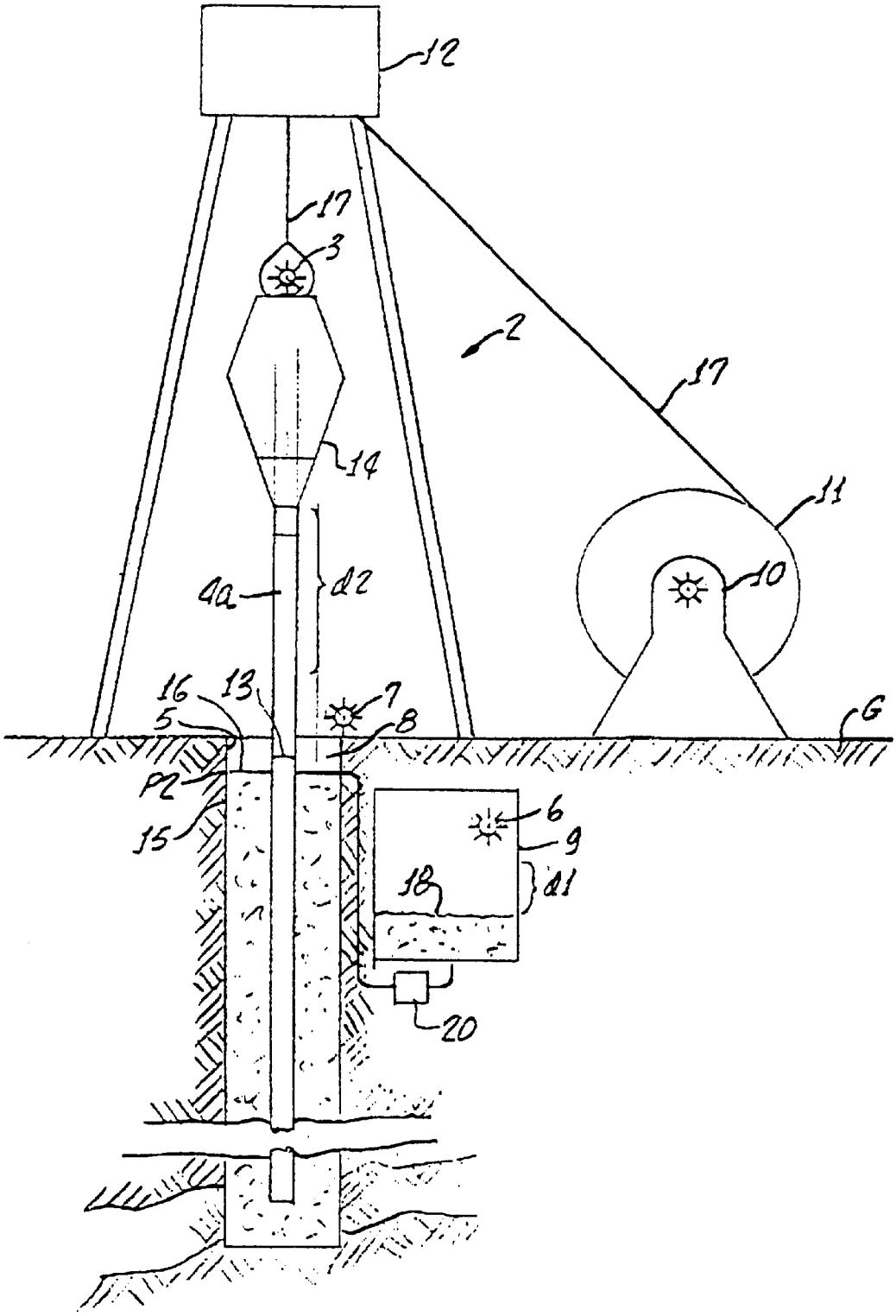
FIG. 2 shows a schematic view of the embodiment of the invention shown in FIG. 1 at a later-in-time second position.

FIG. 2 shows the apparatus embodiment of the invention of FIG. 1 after a section 4*a* of drill string or tubulars 4 has been pulled a distance d2 from the wellbore 5 using drawworks 11 of the drilling rig 12 to pull the cable 17 and raise the top drive 14. The liquid-gas interface 18 within the trip tank 9 has moved down a distance d1 indicating outflow of liquid from the trip tank 9 to the wellbore 5.

The preferred calculation method for detecting if fluid exchange has occurred from the wellbore 5 to an underground formation F involves comparing or totaling measured solid and fluid volume changes (e.g., positive inflows and negative outflows) within the wellbore. For example, if no kick is occurring and the kick tank 9 is supplying a positive liquid volume to make-up for the negative volume of removed tubulars, a zero total should result from adding (as a negative value or subtracting) the differential volume of tubulars and associated equipment 4 removed from the wellbore 5 ($\Delta V_t$) to the changes in fluid volumes in the wellbore, $\Delta V_{wb}$ [equal to the sum of fluid volume changes in the tubular interior ($\Delta V_{ti}$) and in the annulus 8, ($\Delta V_a$)], plus the fluid volume injected into the wellbore from the trip tank 9, $\Delta V_{tt}$. If the total is not zero [i.e., if the reduced volume of tubulars and associated equipment ($\Delta V_t$) is not substantially equal to the changes in fluid volumes, $\Delta V_{ti}+\Delta V_a+\Delta V_{tt}$], the non-zero value is an indication that a fluid exchange with the formation has occurred.

Calculation of measured volume changes is derived at least in part from sensor and other input data. For example, the volume of fluid injected into the wellbore 5 from the trip tank 9 over a period of time ($\Delta V_{tt}$) is calculated from a measured decrease in depth of a liquid-level interface within the trip tank multiplied by the volume associated with a unit change in liquid-level depth within the trip tank. If the unit change in tank liquid volume is not uniform with liquid-level depth changes, a tabular volume versus liquid-level depth can be used to calculate the liquid volume injected into the wellbore 5 from the trip tank 9.

As an example of calculations, the removal of about 90 feet (31.32 meters) of steel tubular having a nominal unit volume of about 0.0075 barrels per foot is approximately equal to the volume removal of 0.675 bbls of steel from the wellbore. Assuming the kick tank sensor 6 indicates a drop in liquid level resulting in the injection of 0.675 bbls of liquid into the wellbore 5 and wellbore liquid-level sensors 3 and 7 indicate no change in liquid level, no fluid exchange with a formation is indicated. Expressed otherwise in absolute value terms, if no fluid exchange with a formation has occurred:

$\Delta V_t=\Delta V_{wb}+\Delta V_{tt}$ when the liquid level 16 in annulus 8 and liquid level 13 in drill string 4 are measured and show no change or $\Delta V_t=\Delta V_{tt}$ when liquid level 16 in annulus 8 is controlled and liquid level 13 in the drill string 4 shows no change, i.e., $\Delta V_{ti}=0$ as measured by the first acoustic sensor, $\Delta V_t=-0.675$ bbls or 0.675 bbls in absolute value, and $\Delta V_{tt}=0.675$ bbls Besides the totaling methods described above, alternative methods for detecting an unwanted fluid exchange with an underground formation are also possible. Alternative methods include comparing measured/calculated volume changes with acceptable values, summing some or all of the measured/calculated volume changes and comparing summed data to acceptable values, and comparing rates of change of measured/calculated volume changes to acceptable values.

The preferred apparatus embodiment of the invention avoids the need for an optional or third liquid-level 7 interface sensor to measure the liquid-level 16 in the annulus 8 since the level is controlled at injection point P1 or P2 by calculating/totaling means and controller 20 and the preferred process embodiment sets changes in annulus liquid level $\Delta V_a$ essentially equal to zero. Thus, any change in the liquid level 13 within the drill string 4 ($\Delta V_{ti}$) would be equal to the change in liquid level within the wellbore, $\Delta V_{wb}$.

Liquid-level control in annulus 8 can be accomplished by a float-operated valve or controller 20 supplying fluid at an injection point, e.g., P1 or P2 where a float is located. Any incremental reduction in liquid level 16 at the injection point P1 or P2 lowers the float that operates a control valve to supply liquid from the trip tank 9 until the liquid level is returned to original level. Control of the liquid-gas interface level 16 in the annulus 8 avoids the need for a third fluid sensor and process steps to measure the liquid-level 16 in the annulus and calculate significant volume changes. Other means for controlling liquid level 16 in the annulus include valves controlled by liquid level sensors and other than floats, differential pressure sensors at P1 or P2 controlling a liquid injection control valve that opens and closes over a range of differential pressures, and a positive displacement pump that is actuated by sensed differential changes in fluid level 16 within annulus 8.

An alternative apparatus embodiment of the invention also comprises an optional threaded plug 19 or other means for consistently mounting a liquid-level sensor (e.g., similar to liquid-level sensor 3) on sections 4*a* of tubular 4 as the sections are removed from the wellbore 5. Other means for consistently mounting a liquid sensor include a tubular mounting tool or fixture, a protective tubing cap having a sensor attaching point, and a sensor-tubing connector.

The apparatus and process of using the invention typically also involves a computer system or other computational device. Inputs to the computer would typically include liquid-gas interface measurements over time, drawworks or other tubular motion measurements over time, and volume conversion factors for calculating solid and liquid volumes from positions/motions of drawworks and liquid interface measurements. Volume corrections and refinements as discussed above may require additional computer inputs and calculations.

If a fluid exchange with a formation is indicated by the inventive method, then corrective action should be at least alarmed or considered. In other words, an alarm should be indicated and corrective action be considered if, in absolute values:

$\Delta V_t \approx \Delta V_{ti} + \Delta V_{tt}$ when the liquid level 16 in the annulus 8 is controlled, and $\Delta V_t \approx \Delta V_{wb} + \Delta V_{tt}$ when the liquid level 16 in the annulus 8 is not controlled.

In addition to alarm indications, some corrective actions may also be automatically implemented by a computer control system if an unwanted fluid exchange is indicated or the discrepancy between the two sides of the above equations is more than a significant value. Corrective actions can include: changing fluid pressures within the wellbore 5, increasing or decreasing the liquid level(s) within the wellbore 5, changing liquid properties within the wellbore, and altering the rotation of the drawworks 11. Indication or selection of the corrective action to be taken may depend on a number of factors, including the risk tolerance of the operator, environmental impacts at the site of a kick problem, the indicated magnitude of fluid exchanged with an underground formation, the process step being accomplished when the exchange occurred, the type of fluid within the wellbore and/or within the formation, and the potential future use of a formation taking fluid.

An alternative process embodiment of the invention includes the step of calculating a rate of fluid exchange with an underground formation and displaying or sounding an alarm if the rate exceeds an acceptable level and/or taking corrective action if the rate exceeds another acceptable level. Selecting the acceptable level(s) can again depend on a number of factors as discussed above. For example, if a formation fluid influx rate of more than about 10 bbls/hr is calculated, an alarm is displayed to the drill rig operators if larger rates can be safely tolerated for short periods and corrective actions implemented if a formation fluid influx rate of 20 bbls/hr is calculated. Although alarm and/or corrective action influx rates are typically no less than about one bbl/hr, they may be as high as 200 bbls/hr or more. More typically, alarm/corrective action influx rates are in the range of about 5 to 50 bbls/hr.

Another alternative process embodiment is to add the step of relocating the liquid-level injection or control point (e.g., from P1 to P2) in the annulus 8 during periods when tubulars 4 are generally being moved into or out of the wellbore 5. Moving the injection or control point during these times can compensate for swabbing effects that tend to decrease bottomhole pressures when tubulars 4 are being withdrawn from the wellbore 4 and increase bottomhole pressures when tubulars are being inserted into the wellbore. For example, moving the controlled liquid-level injection point (e.g., P1) to a higher injection point (e.g., P2) during tubular removal tends to compensate for the swabbing effect when tubulars are removed. The distance between different liquid-level control points may be as much as 100 feet or more, but more typically ranges from about one to 10 feet.

In still another process embodiment of the invention selects a liquid-level control point (e.g., P1 or P2) based at least in part on data from the first liquid-level sensor 3. This may be as simple as allowing liquids to overflow onto the ground G during some operations when inserting tubulars into the well and injecting liquid from the trip tank 9 into a lower level liquid-level injection point during withdrawal operation, but the alternative apparatus and process may also include a computer-based injection point or level control system that also comprises a control valve for directing trip tank outflows into different liquid-level injection points.

Because apparatus and process embodiments of the invention allow kicks to be detected early, application of the invention provides additional safety during tripping operations. Production well reliability, efficiency, and performance may also be improved, e.g., by minimizing drilling fluid loss into a producing formation. Monitoring liquid flow and levels in the wellbore 5 during start-up and shutdown transient periods can also be monitored to provide still further information and/or corrective actions taken for improved well performance and safety.

Although the preferred embodiment of the invention has been shown and described, and some alternative embodiments also shown and/or described, changes and modifications may be made thereto without departing from the invention. Accordingly, it is intended to embrace within the invention all such changes, modifications, and alternative embodiments as fall within the spirit and scope of the appended claims.

What is claimed is:

1. An apparatus for detecting fluid transfer between an underground formation and a wellbore extending below a surface during drilling of said wellbore using a drilling rig, a trip tank fluidly connected to the interior of said wellbore, and a drill string positioned at least in part by said drilling rig and extending at least in part into said wellbore, said apparatus comprising:

(a) an acoustic sensor for measuring changes in the depth of a string liquid level within said drill string, said acoustic sensor mounted proximate to said surface;

(b) a string displacement sensor for measuring the changes in the position of said drill string;

(c) an injected liquid sensor for measuring changes in liquid level in said trip tank;

(d) means for calculating changes in liquid and drill string volumes within said wellbore using at least in part said measured changes in string position, tank liquid level, and string liquid level; and (e) means for totaling said calculated volume changes.

2. The apparatus of claim 1 which also comprises a second acoustic sensor for measuring a liquid level in an annulus between said drill string and said wellbore.

3. The apparatus of claim 2 wherein said means for calculating comprises a computational device.

4. The apparatus of claim 1 which also comprises controller means for maintaining a liquid level within an annulus between said drill string and said wellbore wherein said liquid level is controlled substantially near a first depth from said surface.

5. The apparatus of claim 4 which also comprises controller means for maintaining a liquid level within said annulus substantially near a second depth from said surface not equal to said first depth.

6. The apparatus of claim 5 which also comprises controller means for changing a liquid level with said annulus from said first depth to said second depth.

7. The apparatus of claim 4 wherein said displacement sensor is attached to a drawworks.

8. The apparatus of claim 1 wherein said means for totaling comprises a computational device.

9. An apparatus for detecting fluid transfer between an underground formation and a wellbore extending below a surface during drilling of said wellbore using a drilling rig, a trip tank fluidly connected to the interior of said wellbore, and a drill string positioned at least in part by said drilling rig and extending at least in part into said wellbore, said apparatus comprising:

(a) an acoustic sensor for measuring changes in the depth of a string liquid level within said drill string, said acoustic sensor mounted proximate to said surface;

(b) a string displacement sensor for measuring the changes in the position of said drill string;

(c) an injected liquid sensor for measuring changes in liquid level in said trip tank;

(d) means for calculating changes in liquid and drill string volumes within said wellbore using at least in part said measured changes in string position, tank liquid level, and string liquid level;

(e) means for totaling said calculated volume changes;

(f) controller means for maintaining a liquid level within an annulus between said drill string and said wellbore wherein said liquid level is controlled substantially near a first depth from said surface; and means for slowing the movement of said drill string within said wellbore if said means for totaling indicates fluid exchange between said wellbore and said formation while said drill string is being moved.

10. The apparatus of claim 9 which also comprises means for consistently mounting said acoustic sensor.

11. An apparatus for detecting fluid transfer between an underground formation and a wellbore, said apparatus comprising:

(a) a first liquid level sensor for measuring data used to calculate changes in liquid volume within a tubular located at least in part inside said wellbore;

(b) a motion sensor for measuring motion data used to calculate changes in tubular volume of said tubular within said wellbore;

(c) a second liquid sensor for measuring data used to calculate a liquid volume injected into said wellbore; and (d) a computational device for calculating injected liquid volume, changes in liquid volume within said wellbore, and changes in tubular volume within said wellbore.

12. The apparatus of claim 11 which also comprises a computational device for totaling injected liquid volume, changes in liquid volume with said wellbore, and changes in tubular volume with said wellbore.

13. The apparatus of claim 12 which also comprises a tank for supplying an injected liquid volume into said wellbore and wherein said second liquid sensor comprises an acoustic-type sensor for detecting liquid level changes within said tank.

14. An apparatus for detecting fluid transfer between an underground formation and a wellbore, said apparatus comprising:

(a) a first liquid sensor for measuring data used to calculate changes in liquid volume within a tubular located at least in part inside said wellbore;

(b) a motion sensor for measuring data used to calculate changes in tubular volume of said tubular within said wellbore;

(c) a second liquid sensor for measuring data used to calculate a liquid volume injected into said wellbore; and (d) a computational device for calculating injected liquid volume, changes in liquid volume within said wellbore, and changes in tubular volume within said wellbore;

(e) a computational device for totaling injected liquid volume, changes in liquid volume within said wellbore, and changes in tubular volume within said wellbore;

(f) a tank for supplying an injected liquid volume into said wellbore and wherein said second liquid sensor comprises an acoustic-type sensor for detecting liquid level changes within said tank; and (g) means for mounting at least one of said liquid sensors on said tubular.

15. The apparatus of claim 14 which also comprises a controller for controlling an annular liquid level within said wellbore at substantially a first level in an annular space between said wellbore and said drill string.

16. The apparatus of claim 15 wherein the controller comprises means for controlling a liquid level at substantially a second level in said annular space.

17. The apparatus of claim 16 wherein the controller further comprises means for changing said liquid level in said annular space from said first level to said second level.

18. A process for detecting fluid transfer between an underground formation and a wellbore comprising:

(a) drilling said wellbore using a drilling rig and a tubular extending into said wellbore;

(b) detecting liquid volume changes over time within said tubular;

(c) detecting an injected liquid volume supplied to said wellbore;

(d) detecting a tubular volume withdrawn within said wellbore; and (e) comparing said tubular liquid volume change with said liquid volume supplied less said tubular volume withdrawn.

19. The process of claim 18 which also comprises the step of actuating an alarm signal if said comparing step (e) indicates fluid exchange between said wellbore and said underground formation.

20. The process of claim 18 which also comprises the step of actuating an alarm if said comparing step indicates a difference in volume changes of at least 10 bbls/hr.

21. A process for detecting fluid transfer between an underground formation and a wellbore comprising:

(a) drilling said wellbore using a drilling rig and a tubular extending into said wellbore;

(b) detecting liquid volume changes over time within said tubular;

(c) detecting an injected liquid volume supplied to said wellbore;

(d) detecting a tubular volume withdrawn within said wellbore; and (e) comparing said tubular liquid volume change with said liquid volume supplied less said tubular volume withdrawn;

(f) actuating an alarm signal if said comparing step (e) indicates fluid exchange between said wellbore and said underground formation; and (g) changing the rate of tubular volume withdrawal if said comparing in step (e) indicates significant fluid exchange between said wellbore and said underground formation.

22. The process of claim 21 which also comprises the step of controlling an annular liquid level between said tubular and said wellbore at a first location within said wellbore.

23. The process of claim 22 which also comprises the step of controlling said annular liquid level at a second location within said wellbore.

24. A process for detecting fluid transfer between an underground formation and a wellbore comprising:

(a) drilling said wellbore using a drilling rig and a tubular extending into said wellbore;

(b) detecting liquid volume changes over time within said tubular;

(c) detecting an injected liquid volume supplied to said wellbore;

(d) detecting a tubular volume withdrawn within said wellbore;

(e) comparing said tubular liquid volume change with said liquid volume supplied less said tubular volume withdrawn; and (f) controlling said annular liquid level at said first location when said tubular is generally being withdrawn into said wellbore and controlling said annular liquid level at said second location when said tubulars are generally withdrawn from said wellbore.

25. The process of claim 24 which also comprises the step of correcting said tubular volume changes using at least in part an estimate of changes in a length of a supporting cable.

26. An apparatus for detecting fluid changes within a movable tubular assembly located within an underground well, said apparatus comprising:

a liquid level detector for detecting the location of a liquid level within said tubular assembly when said movable tubular assembly is located at a first position;

means for transmitting a signal representative of said location of said liquid level; and means for relocating said liquid level detector to a second position.

27. The apparatus of claim 26 wherein said means for relocating said liquid level detector comprises re-mounting said liquid level detector near the top of said tubular assembly.

28. An apparatus for detecting fluid changes within a movable tubular assembly, said tubular assembly being used to drill an underground well below a surface, said apparatus comprising:

a liquid level detector for detecting the location of a liquid level within said tubular assembly when said tubular assembly is at a first position wherein said liquid level detector is mounted proximate to a top drive of a drilling rig; and means for transmitting a signal representative of said location of said liquid level.

29. The apparatus of claim 28 wherein said liquid level detector and means for transmitting a signal comprises an acoustic-type liquid level sensor and receiver unit.

30. A method for detecting fluid changes within a movable tubular assembly located at least in part within an underground well, said method comprising:

first detecting the location of a liquid level within said tubular assembly when said tubular assembly is at a first position;

moving said tubular; and second detecting the location of a liquid level within said moved tubular assembly.

31. The method of claim 30 which also comprises the step of disassembling a portion of said tubular assembly prior to said second detecting step.

* * * * *